US006074328A

United States Patent [19]

Johnson

[11] Patent Number: 6,074,328

[45] Date of Patent: Jun. 13, 2000

[54] LINKED LEVERAGE EXERCISE SYSTEM

[75] Inventor: Karl W. Johnson, Studio City, Calif.

[73] Assignee: Paramount Fitness Corp., Los Angeles, Calif.

[21] Appl. No.: 09/148,686

[22] Filed: Sep. 4, 1998

Related U.S. Application Data

[63] Continuation-in-part of application No. 09/060,272, Apr. 14, 1998, abandoned.

[60] Provisional application No. 60/042,229, Apr. 15, 1997.

[51] Int. Cl.[7] ..... A63B 21/06

[52] U.S. Cl. ..... 482/97; 482/137

[58] Field of Search ..... 482/94–97, 100, 482/137, 138

[56] References Cited

U.S. PATENT DOCUMENTS

| | | | |
|---|---|---|---|
| 126,796 | 5/1872 | Forward | 482/97 |
| 839,040 | 12/1906 | Schmidt | 482/97 |
| 4,357,010 | 11/1982 | Telle | 482/97 |
| 4,790,530 | 12/1988 | Maag | 482/97 |
| 4,863,161 | 9/1989 | Telle | 482/97 |
| 5,263,914 | 11/1993 | Simonson et al. | 482/100 |
| 5,344,374 | 9/1994 | Telle | 482/97 |
| 5,395,295 | 3/1995 | Ish | 482/100 |
| 5,702,328 | 12/1997 | Mansvelt | 482/974 |
| 5,749,813 | 5/1998 | Domzalski | 482/97 |

FOREIGN PATENT DOCUMENTS

| | | | |
|---|---|---|---|
| 244071 | 3/1987 | Germany | 482/97 |

*Primary Examiner*—John Mulcahy
*Attorney, Agent, or Firm*—Fulbright & Jaworski LLP

[57] ABSTRACT

An exercise device having a pivoted resistance and a two-piece pivoted linkage assembly to connect the resistance with the user. A user impact device, for receiving force from the user may be connected to the two-piece pivoted linkage assembly. The respective lengths of the two pieces of the linkage assemble and the points of pivotal mounting are used to determine the resistance profile.

39 Claims, 10 Drawing Sheets

LINKED LEVERAGE EXERCISE SYSTEM

This is a continuation-in-part of U.S. application Ser. No. 09/060,272, filed Apr. 14, 1998, now abandoned, which in turn claims priority of U.S. application Ser. No. 60/042,229, filed Apr. 15, 1997.

TECHNICAL FIELD OF THE INVENTION

The invention relates to exercise devices, and more specifically to exercise devices in which the resistance experienced by the user is controlled to approximate a predetermined profile by the use of a lateral mass swing arm, along which a weight may be positioned by the user, and by the use of various lengths and pivot locations of a two piece pivoted linkage assembly, connecting the mass swing arm with a user means.

BACKGROUND OF THE INVENTION

Conventional selectorized weight machines utilize a stack of individual weight plates that move vertically on a pair of parallel bars. These weights are typically coupled to the resistive mechanism of the machine by cables or belts traveling over pulleys and a variable resistance cam. They may also be directly linked by a lever system such as is described in U.S. Letters Pat. No. RE31113 entitled Variable Resistance Lifting Device. The variable resistance generated by the cam in these machines conforms to a biomechanical pattern resulting in a uniform feeling exercise pattern, conforming to the desires and expectations of most users.

Typically, prior art machines, such as those designed for leg extensions, leg curls and arm curls, have to precisely align the user's joint center with the machine axis. This has been critical for the proper function and feel of the machine. Without this proper alignment, as the user moves through the motion arc of the machine, the user and the machine move through different arcs, causing the user to bind or reach during the motion.

These prior art machines all have the additional disadvantage of a large number of components which are subject to wear, and a significant vertical clearance required to house the moveable weight stack.

Free-weight machines that utilize individual weights (placed on the machine by the user) have now been designed to approximate the exercise profile of the selectorized weight machines. Unfortunately, each weight plate has to be loaded and unloaded by hand, causing inconvenience to the user and added cost to the owner of the exercise facility, as large quantities and combinations of weights must be present to satisfy the needs of different users. Additionally, the levers and linkages installed in these free-weight machines to approximate the selectorized weight machine profile are often inaccurate, and the user may experience an undesirable resistance profile.

Electronic means have been employed to vary the position of a constant mass or weight along the lever. Patents describing such devices include the Telle (U.S. Pat. No. 4,863,161), Cartwright (U.S. Pat. No. 4,650,185) and Jungeris (U.S. Pat. No. 3,588,101). Unfortunately, electric motors result in increased cost and maintenance.

What is needed is an exercise device in which resistance can be easily adjusted by the user, that will match a predetermined resistance profile throughout the exercise stroke (i.e., the user starting in an at-rest position, exerting force against resistance generated by the exercise device and then reversing the process), does not require a high vertical clearance for a weight stack, and is low in maintenance.

SUMMARY OF THE INVENTION

In one embodiment, the present invention provides a device for a linked leverage exercise system, including a frame, a mass swing arm disposed generally horizontally in an at-rest position and pivotally mounted to the frame for arcuate movement, resistance means mounted on the mass swing arm, means for selectively engaging the resistance means, a user means for transmitting force from a user to the mass swing arm, and a linkage assembly for pivotally linking the mass swing arm with the user means and the frame. The linkage assembly includes a hoisting link bar pivotally interconnecting the mass swing arm with a pivotal frame member and a pivotal frame member pivotally interconnecting the hoisting link bar with the frame. The user means is pivotally mounted to the linkage assembly. The present invention allows various force profiles to be predetermined by the relative lengths of the hoisting link bar and the pivotal frame member, the locations of the pivot connections of the mass swing arm to the frame and the mass swing arm to the hoisting link bar, and the location of pivotal mounting of the user means to the linkage assembly.

In a second embodiment, the present invention includes a weight selector connected to a resistance means slidably mounted to an adjustment tube. The tube has a plurality of locking apertures. The selector has a shaft, a handle mounted to the shaft at one end of the shaft and a post mounted to the other end. A spring urges the shaft to engage locking apertures in the tube. The post section engaged in an aperture resists movement of the movable mass unless the handle is urged away from the locking aperture.

These and other features and advantages of this invention will become further apparent from the detailed description and accompanying figures that follow. In the figures and description, numerals indicate the various features of the invention, like numerals referring to like features throughout both the drawings and the description.

DETAILED DESCRIPTION OF THE INVENTION

The present invention allows different exercise machines to be constructed for different exercises, each machine having a particular resistance profile (the resistance experienced by the user as the exercise is performed), ideally matching that desired by users of the particular exercise. Each machine includes a weight or resistance means mounted on a mass swing arm, which arm is generally horizontal in an at-rest position and is pivotally mounted to a frame. A user means receives force from the user and transmits it to pivot the mass swing arm upwards via a linkage assembly. The linkage assembly includes a hoisting link bar, pivotally connected to the mass swing arm, and a pivotal frame member which is pivotally connected to the hoisting link bar and to the frame of the device. The user means is mounted to the linkage assembly. Various resistance profiles can be achieved by altering the relative lengths of the hoisting link bar and the pivotal frame member, and the locations of the pivot connections of the mass swing arm to the hoisting lift bar, the pivotal frame member to the hoisting lift bar and to the frame, the user means to the linkage assembly, and the mass swing arm to the frame.

Figure 1:
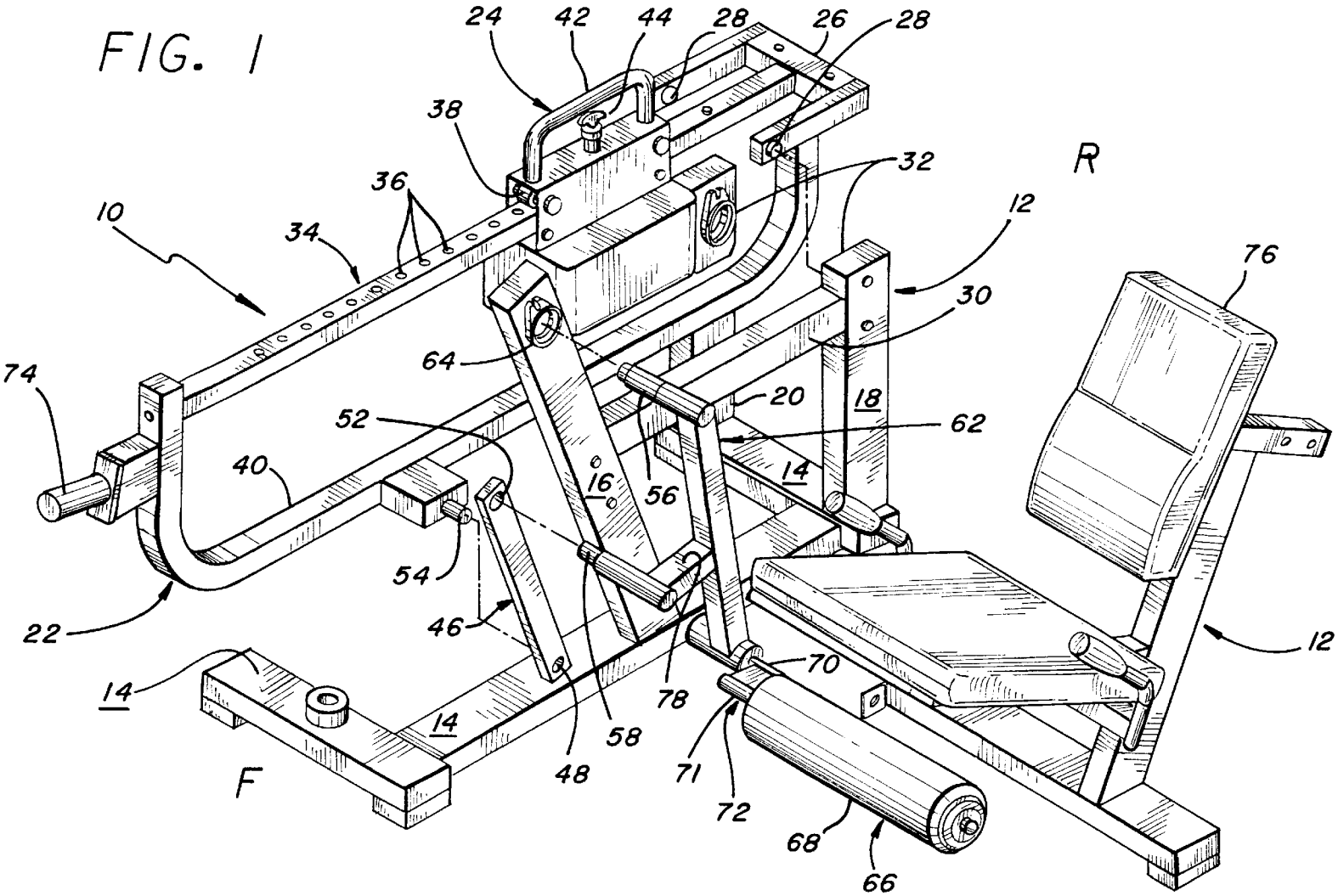
FIG. 1 is an isometric, exploded view of a preferred embodiment of the present invention, employed in the context of a leg extension machine.

FIG. 1 shows a first embodiment of the linked leverage exercise system of the present invention in the form of a leg extension machine 10. The leg extension machine 10 includes a rigid frame 12 which can be made of any number of materials. However, structural steel has been found to work well. The frame 12 has a forward end ("F" in FIG. 1) and a rearward end ("R" in FIG. 1). The frame 12 also has a base portion 14 resting in direct or indirect contact with the ground, a support arm 16 rigidly mounted to and generally extending upright from the base portion 14, two upright members 18 and 20 rigidly mounted to the base portion 14 adjacent to the rearward end thereof and a support beam 30 rigidly connecting upright member 18 to support arm 16. A mass swing arm 22 is provided for supporting the weight of a movable mass 24. The mass swing arm 22 has forward and rearward ends which generally correspond to the forward and rearward ends of the frame 12, and a U-shaped member 26 rigidly mounted to the rearward end of the mass swing arm 22 for pivotally mounting the swing arm 22 to the frame. The U-shaped member 26 has two swing arm pivots 28, at the open ends of the U-shaped member 26, which rotatably engage a pair of swing arm pivot apertures 32 in the upper ends of the of the upright members 18 and 20. To avoid wear due to friction, ball bearings or bushing bearings are fitted inside apertures 32, as well as in all other pivot-receiving apertures in the present invention.

The mass swing arm 22 further comprises an adjustment tube 34 which is bored with a plurality of mounting apertures, such as apertures 36, and a depending C-shaped member 40 which is rigidly mounted to the front and rear of the adjustment tube 34. The movable mass 24 is slidably mounted on the adjustment tube 34 and has a plurality of rollers 38 engaging the top surface of the adjustment tube 34, allowing the movable mass 24 to roll over the adjustment tube 34. Thus the user may grasp a handle 42 attached to the movable mass 24 and slide the movable mass 24 along the length of the adjustment tube 34, thereby adjusting the resistance until the desired point (resistance level) is reached. The user may then set the movable mass 24 in place by releasing a mass selection pin 44 and allowing said pin to enter the desired one of the apertures 36.

The mass swing arm 22 has an auxiliary weight holder 74 rigidly mounted to the forward end of the mass swing arm 22. In this first embodiment, the auxiliary weight holder 74 takes the form of a metal bar on which weights (not shown) having a circular center aperture can be placed.

A hoisting link bar 46 has a lower link bar aperture 48 at its lower end and an upper link bar aperture 52 at its upper end. Lower link bar aperture 48 receives lower link pivot 54 which is rigidly mounted to the C-shaped member 40 of the mass swing arm 22, thus pivotally mounting the hoisting link bar 46 to the mass swing arm 22. The upper link bar aperture 52 pivotally receives a middle axle 58 of pivotal frame member 62, to pivotally mount the hoisting link bar 46 to the pivotal frame member 62. In this embodiment the middle axle 58 is spaced forward of the remainder of the pivotal frame member 62 by use of a rigidly mounted extension 78. The pivotal frame member 62 also has an upper axle 56 which is pivotally received in aperture 64 in the upper end of support arm 16. Thus, pivotal frame member 62 is pivotally mounted to the frame 12 and to the hoisting link bar 46. This linked pivotal connection between the mass swing arm 22, the hoisting link bar 46, the pivotal frame member 62 and the frame 12 allows various resistance profiles to be achieved by varying the lengths and pivotal connection locations of the hoisting link bar 46 and the pivotal frame member 62.

A user means 66 is provided for receiving force from the user and transmitting that force to the movable mass 24. The user means 66 can take many forms depending upon the particular exercise for which a given embodiment of the present invention is designed. In this first embodiment, designed for use in leg extension exercises, the user means 66 comprises a padded shin bar 68 for receiving the shins and ankles of the user.

The user means 66 can be attached to virtually any location along the pivotal frame member 62, again depending upon the particular arc or resistance profile desired. It has been found that a resultant arc and resistance profile well suited for a leg extension machine can be achieved when the user means 66 is interconnected with the pivotal frame member 62 in a rotatable manner at a point distant from the upper axle 56 and the middle axle 58. As discussed below, in other embodiments, designed for other exercises or different resistance profiles, the user means 66 may be attached to the pivotal frame member 62 at a different location or even to the hoisting link bar 46, again depending upon the specific application.

As can be seen from FIG. 1, the location of the pivotal aperture 64 on the support arm 16 and the length of the pivotal frame member 62 are not subject to user modification. Prior art devices have attempted to match the location of the joint of the limb being exercised (in the embodiment in FIG. 1, the knee joint) with the locus of the arc about which the limb is moving and also the distance from the user's joint to the part of the user transmitting force (in this case, knee-to-ankle), as it was believed that this was the only way to avoid the binding and undesirable resistance profile typically resulting from any mismatch (in FIG. 1, that locus is pivotal aperture 64). However, it has been found that such problems can be avoided by the placement of the pivotal aperture 64 along the support arm 16 and adjusting the length of the pivotal frame member 62 such that the arc measured from the pivotal aperture 64 to the padded shin bar 68 is approximately one and one-half times greater than would be expected if the resulting arc was to match that of knee-to-ankle arc, that is, pivoting the lower leg about the knee joint. To further avoid difficulty in using the device due to mismatched arcs and to accommodate users of different limb lengths, the user means 66 comprises a self-adjusting mechanism. In this first embodiment, the self-adjusting mechanism is a Z-shaped accommodating lever arm 72 having two generally parallel pivots, a frame pivot 70 pivotally mounted to the lower end of the pivotal frame member 62 and a user pivot 71 pivotally mounted to the padded shin bar 68. The distance between the axes described by the frame pivot 70 and the user pivot 71 is approximately three inches, allowing the padded shin bar 68 to rotate about a circle having a six inch diameter. In other embodiments, the accommodating lever arm 72 of the present invention can be used to compensate for users having differing arm lengths, heights or other body dimensions.

An adjustable seat 76 attached to the frame 12 is also provided, which can take the form of any number of commercially available exercise seats with laterally adjustable back supports. The adjustable seat 76 is mounted so that a person sitting in the seat is positioned with ankles or shins engaging the padded shin bar 68 or the user means 66.

In operation, the user will adjust the adjustable seat 76 so that the seat back is far enough forward to allow the user's ankles or shins to comfortably reach the padded shin bar 68. Next the user will adjust the movable mass 24 (described in greater detail below). As the user's shins or ankles engage the padded shin bar 68, the shin bar 68 will move closer to or away from the adjustable seat 76 to compensate for the differing leg lengths of various users. With feet and ankles behind and beneath the padded shin bar 68, torso in the adjustable seat 76, and legs necessarily bent at approximately a 90 degree angle, the user will begin to exercise by extending the ankles forward (toward the forward end of the machine) and upward. The ankles will in turn urge the padded shin bar 68 and thus also urge the user means 66 (including the accommodating lever arm 72) forward and upward. The user means 66 will urge the lower end of the pivotal frame member 62 in the same directions, while the movement of the pivotal frame member 62 is restrained to arc about the frame pivotal aperture 64. Due to the connection of the pivotal frame member 62 to the hoisting link bar 46 by middle axle 58 in upper aperture 52, the pivotal frame member 62 will urge the link bar 46 about a second upward arc which is generally smaller than the arc described by the movement of the user means 66. The hoisting link bar 46 will pull upwardly the lower link pivot 54 in lower link bar aperture 48 and thus the mass swing arm 22 will move upward, pivoting the mass swing arm 22 about the swing arm pivots 28. The movement of the mass swing arm 22 raises the movable mass 24, thus resulting in resistance being experienced by the user. Movement of the mass swing arm 22 will be less than that of the user means 66 due to the above-noted differing arcs, and the placement of the lower link pivot 54 distant from the forward end of the C-shaped member 40.

The user may control the amount of resistance by, prior to the exercise and with the mass swing arm 22 in a generally horizontal orientation, releasing the movable mass 24 by grasping the mass selection pin 44 and pulling it upwards (away from the movable mass 24) and sliding the movable mass 24 along the adjustment tube adjustment tube 34 on its rollers 38. Sliding the movable mass 24 rearwardly will reduce the resistance felt by the user, while sliding it forwardly will increase such resistance. Once in the proper position, the movable mass 24 may be secured in place by releasing the mass selection pin 44 and allowing it to enter the nearest of the apertures 36 in the adjustment tube 34. Advanced athletes and exercisers who desire additional resistance may place free weights (not shown) on the auxiliary weight holder 74.

The particular resistance profile to be experienced by the user is determined by a number of factors: the placement of the lower link pivot 54 along the mass swing arm 22; the relative lengths of the hoisting link bar 46 and the pivotal frame member 62; and the location of the various pivotal connections. In this first embodiment, it has been found that a particularly desirable resistance profile can be achieved by utilizing the following dimensions and pivot locations. The mass swing arm 22 is approximately 59 inches in length. The swing arm pivots 28 are located about 8.5 inches from the rearward end of the mass swing arm 22. The lower link pivot 54 is located about 29.5 inches forward of the swing arm pivots 28 (measured horizontally). The swing arm pivot apertures 32 are located approximately 17 inches above the base portion 14 of the frame 12. The link bar 46 is approximately 19 inches long (and the distance between the two apertures is approximately 17 inches). The pivotal frame member 62 measures about 21.5 inches from the end received by the frame pivotal aperture 64 to the end receiving the accommodating lever arm 72. The pivotal frame member 62 has an extension 78 measuring about 4.5 inches in length and located about 11.5 inches from the axle 56, and extending about 5.5 inches laterally from the pivotal frame member 62.

To vary the resistance profile, the lower link pivot 54 can be variously positioned along the depending C-shaped member 40 of the mass swing arm 22 by drilling holes along the member 40 and securing the pivot in any of these various holes by both passing a shaft from the pivot 54 through the selected hole and securing a nut to the shaft on the opposite side of the member 40.

Figure 1A:
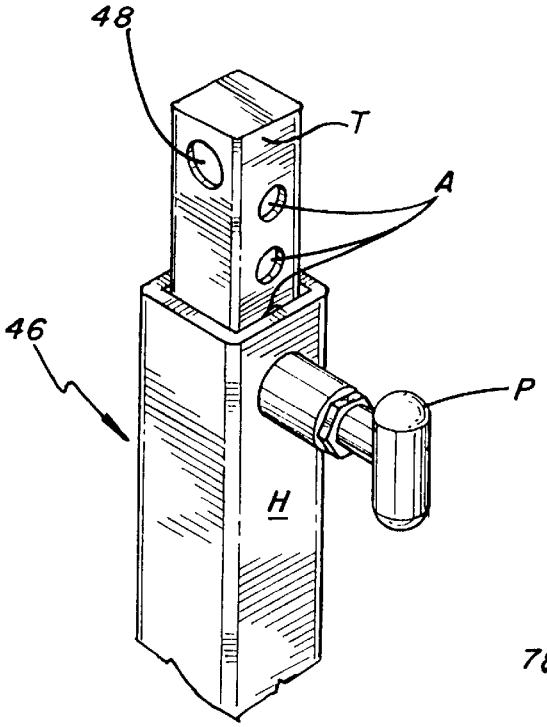
FIG. 1A is an isometric view of a portion of an alternative embodiment of the leg extension machine of FIG. 1.

The relative length of the hoisting link bar 46 can be varied by constructing it to telescope. For example, as shown in FIG. 1A, the shaft of hoisting link bar 46 comprises a solid telescoping portion T, and a hollow portion H with a larger circumference. Thus, the solid telescoping portion T will slide within the hollow portion H, varying the distance between the lower link bar aperture 48 and the upper link bar aperture 52 (FIG. 1). The telescoping portion T will be drilled through with apertures, such as apertures A, to receive a pin P which also passes through an aperture (not shown) in the hollow portion H. The user will select one of the apertures A in the solid telescoping portion T to achieve the desired length of the hoisting link bar 46, align it with the aperture in the hollow portion H, and insert the pin P to hold the appropriate telescoping length of the link bar 46 as selected.

Figure 1B:
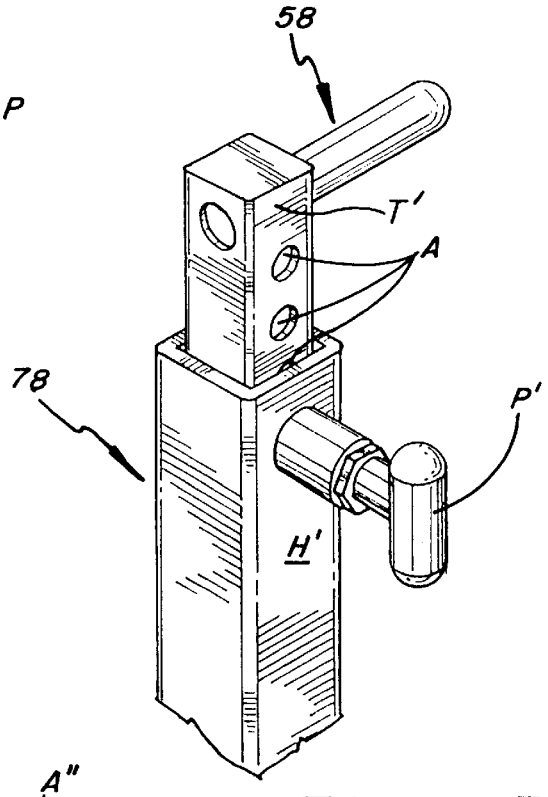
FIG. 1B is an isometric view of a portion of an alternative embodiment of the leg extension machine of FIG. 1.

The position of the middle axle 58 relative to the extension 78 may also be varied, by constructing the extension 78 to telescope. For example, as shown in FIG. 1B, the shaft of extension 78 comprises a solid telescoping portion T', and a hollow portion H' with a larger circumference. Thus, the solid telescoping portion T' will slide within the hollow portion H', varying the distance between the middle axle 58 and the pivotal frame member 62 (FIG. 1). The telescoping portion T' will be drilled through with apertures, such as apertures A', to receive a pin P' which also passes through an aperture (not shown) in the hollow portion H'. The user will select one of the apertures A' in the solid telescoping portion T' to achieve the desired length of the extension 78, align the selected aperture A' with the aperture in the hollow portion H', and insert the pin P' to hold the appropriate telescoping length of the extension 78 as selected.

Figure 1C:
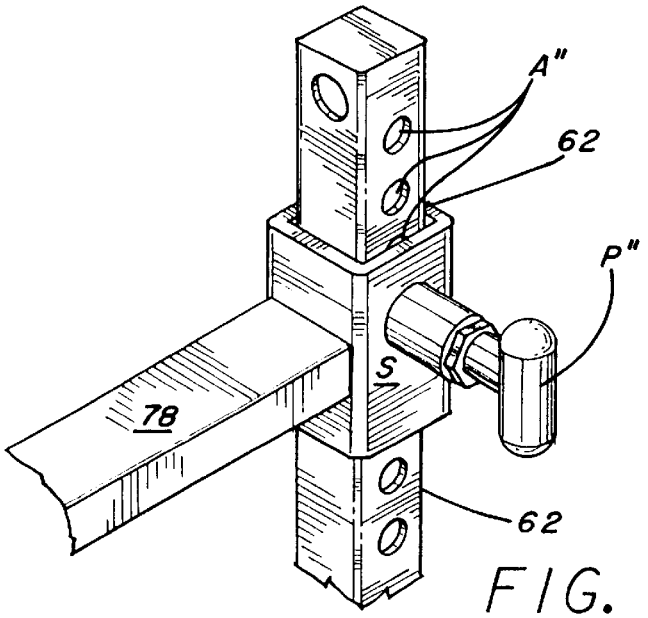
FIG. 1C is an isometric view of a portion of an alternative embodiment of the leg extension machine of FIG. 1.

The relative position of the extension 78 along pivotal frame member 62 may be varied in a similar manner. For example, as shown in FIG. 1C, the extension 78 may be secured to a sleeve S which slidably surrounds the pivotal frame member 62. Pivotal frame member 62 will be drilled through with apertures, such as apertures A", to receive a pin P" which also passes through an aperture (not shown) in the sleeve S. The user will select one of the apertures A" in the pivotal frame member 62 to achieve the desired position of the extension 78, align the selected aperture A" with the aperture in the sleeve S, and insert the pin P" to hold the appropriate position of the extension 78 relative to the pivotal frame member 62, as selected.

Similarly, the pivotal connections of the mass swing arm 22 to the frame may be made variable by extending the length of the arms of U-shaped member 26 in the same telescoping manner described above with reference to FIGS. 1A, 1B, and 1C. Furthermore, additional swing arm pivot apertures, such as swing arm pivotal apertures 32, can be installed on upright members 18 and 20, to allow the U-shaped member 26 to be attached at different heights.

The position of the accommodating lever arm 72 can be varied relative to the pivotal frame member 62 by drilling holes along the pivotal frame member 62 and securing the frame pivot 70 in any of these various holes. Similarly, the location of the frame pivotal aperture 64 can be varied relative to the frame 12 by drilling holes along the support arm 16 and securing the axle 56 in any of those various holes. For additional flexibility, the support arm 16 can be severed from the support beam 30 and from the base portion 14 of the frame 12, a pair of parallel plates welded to the base portion 14 at the point at which the support arm 16 had been severed, a pair of holes drilled in the plates, and a corresponding hole drilled in the base of the support arm 16 and a pivot inserted through said holes in the plates and the support arm, so that the support arm 16 is pivotally mounted to the base portion. To lock the support arm 16 in a desired orientation, holes can be drilled in the support arm 16, and corresponding holes in the support beam 30, and a bolt inserted though the holes in the support arm 16 and the support beam 30, and securing it in place with a nut. The holes in the support beam 30 should be spaced so as to allow the frame pivotal aperture 64 to radially travel no more than about two inches.

Figure 2:
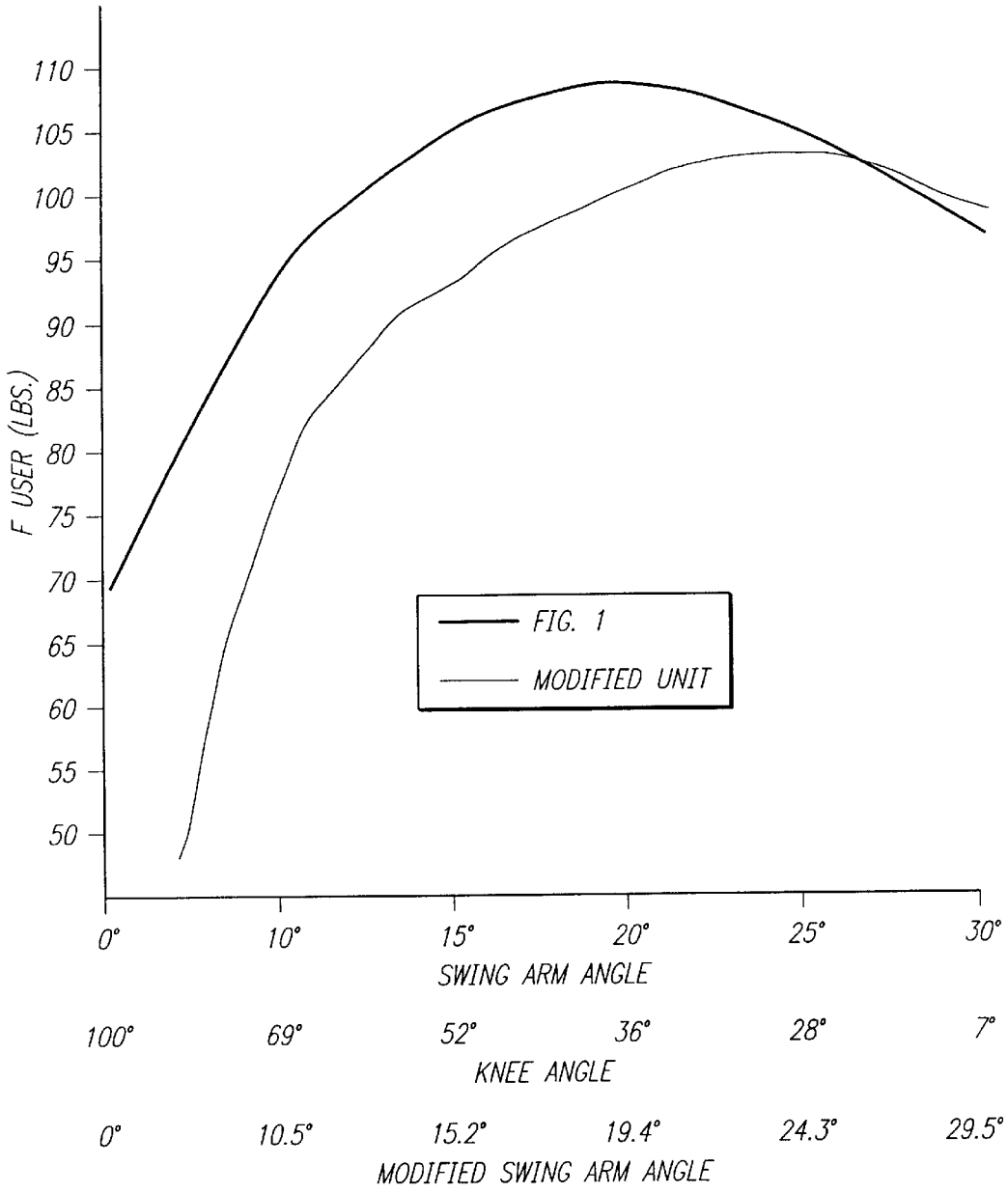
FIG. 2 is a graph showing the resistance profile experienced by the user of the machine depicted in FIG. 1 and the resistence profile experienced by the user of a modified form of the machine depicted in FIG. 1.

Varying any one of the above factors can significantly alter the resistance profile. FIG. 2 shows the resistance profile of the first embodiment (solid line) and that of a modified system (broken line) in which the lower link pivot 54 was moved rearward approximately 3 inches, extension 78 was shortened about 3 inches and hoisting link bar 46 shortened about 0.25 inches. As can be seen, the force exerted by the user ($F_{-USER}$) varies significantly between the two embodiments. This is particularly apparent at the beginning of the exercise cycle, where the $F_{-USER}$ approaches zero in the modified unit. Virtually unlimited profiles are possible by varying the above-noted structures.

As can also be seen from FIG. 2, as the user (in this embodiment, the user's legs) moves through the range of motion of the exercise (approximately 93 degrees), the mass swing arm 22 moves only about 30 degrees. Significantly greater movement of the mass swing arm 22 would interfere with the resistance profile. For instance, if the mass swing arm 22 approached 90 degrees of movement, the resistance encountered by the user ($F_{-USER}$) would approach zero.

Figure 3:
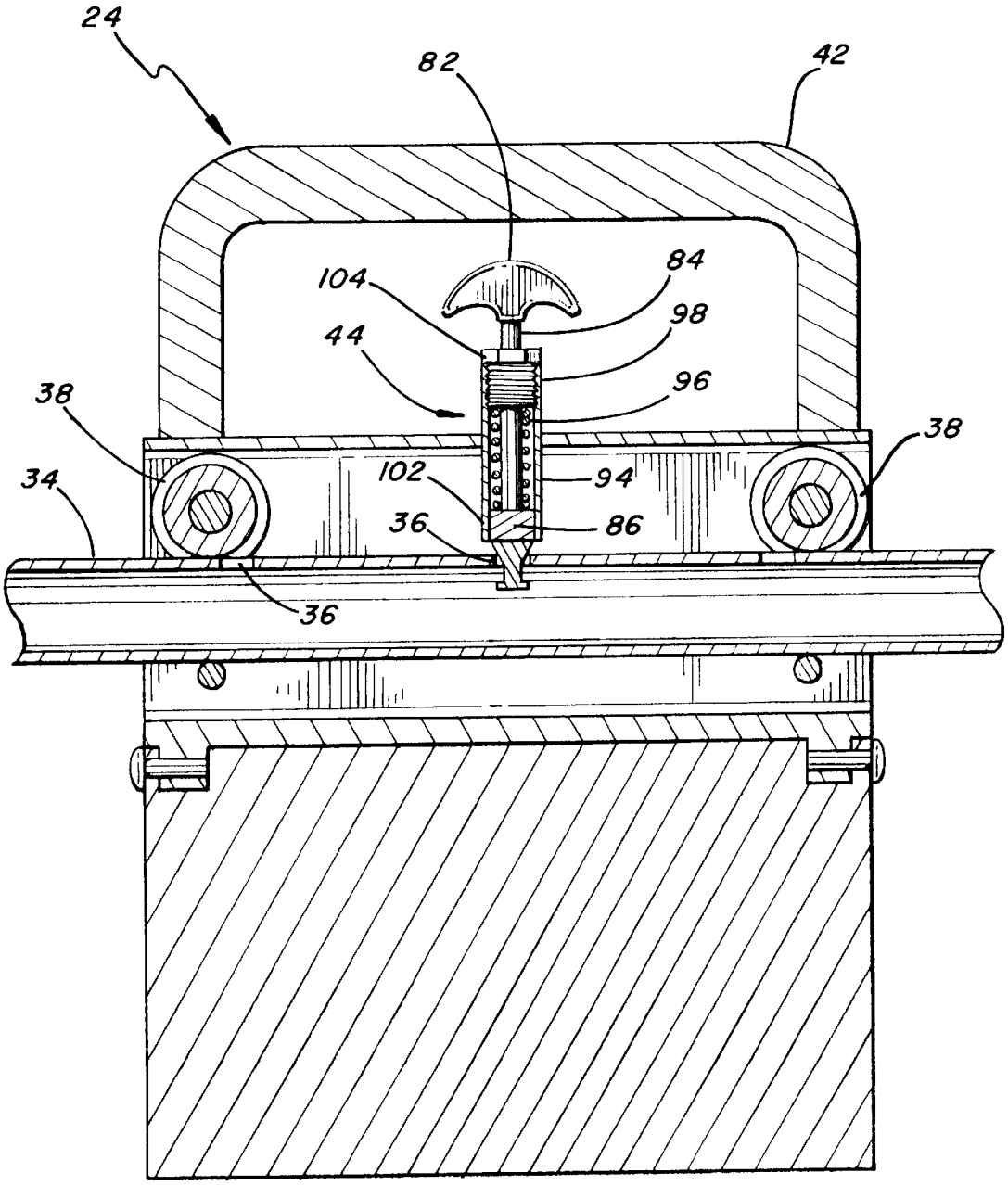
FIG. 3 is a cross-sectional, elevational view of the movable mass of the present invention.
Figure 4:
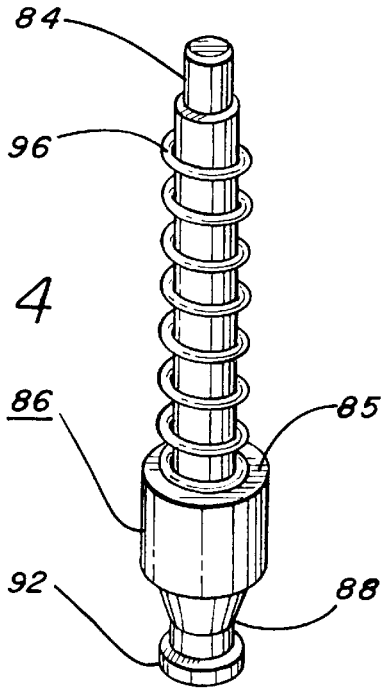
FIG. 4. is an isometric view of a portion of the mass selection pin of FIG. 3.

FIG. 3 shows the movable mass 24 of the present invention in cross-section. It can be seen that the two rollers 38 engage the surface of the adjustment tube 34, while the mass selection pin 44 secures the movable mass 24 in place by engaging one of the apertures 36 in the adjustment tube 34. Referring to FIGS. 3 and 4, the mass selection pin 44 includes a handle 82, which is connected to a shaft 84. The handle 82 and shaft 84 are capable of upward (away from the adjustment tube 34) and downward (towards the adjustment tube 34) movement. The end of the shaft 84 opposite the handle 82 includes a post 86, having a diameter wider than the shaft 84, creating a ledge 85 and also having a conical section 88 with a lip 92 at the end. A tubular housing 94 has an upper end 98 and a lower nd 102, and encloses the shaft 84 and a compression spring 96. The compression spring 96 surrounds the shaft 84, and is resisted at one end by the ledge 85 and at the other end by a nut 104. Nut 104 has an aperture though which the shaft 84 passes, and a threaded circumference which screws into interior threads in the upper end 98 of the tubular housing 94. Downward movement of the handle 82 (and thus the shaft 84 and post 86) is limited by the handle 82 bearing against the nut 104.

In operation, when the movable mass 24 is positioned so that the mass selection pin 44 is over one of the apertures 36, the compression spring 96 will urge the ledge 85, post 86 and therefore the shaft 84, conical section 88 and lip 92, into the aperture 36. Excessive downward movement will be restrained by the handle 82 bearing against the nut 104. When the user wishes to move the movable mass 24, the user will pull the handle 82 upward against the compression spring 96, causing the post 86, conical section 88, and lip 92 to raise out of the aperture 36. When the user has positioned the movable mass 24 in the proper position for the desired amount of resistance, the user will release the handle 82 allowing the post 86, conical section 88 and lip 92 to drop into the aperture 36, securing the movable mass 24 in place. When the leg extension machine 10 (or other embodiment of the present invention) is used, the mass swing arm 22 will be angled upwards and downwards, covering a range that could be as much as 35 degrees or more (depending upon the application). In the event that such movement jars the mass selection pin 44, causing the pin to begin to loosen, rather than slipping out of the aperture 36 as the movable mass begins downward movement along the adjustment tube 34, the lip 92 will engage the interior rim of the aperture 36, preventing the mass selection pin 44 from coming loose and the resulting unwanted movement of the movable mass 24. The conical section 88 is at its smallest circumference at the point it meets the lip 92 to provide a groove to engage the rim of the aperture 36, thus securing the movable mass 24.

Figure 5:
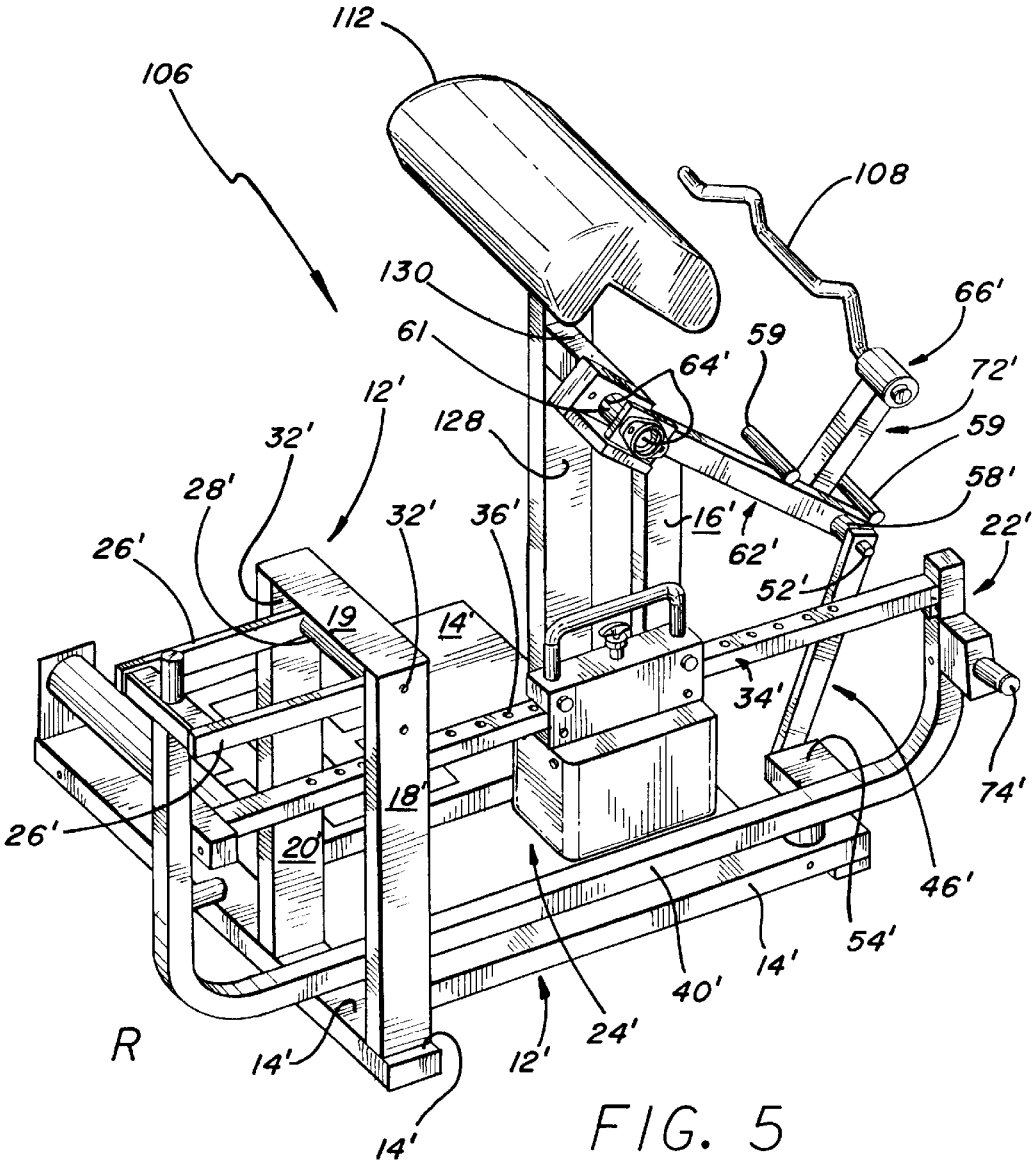
FIG. 5 is an isometric view of a second embodiment of the present invention, employed in the context of a biceps curl machine.
Figure 5A:
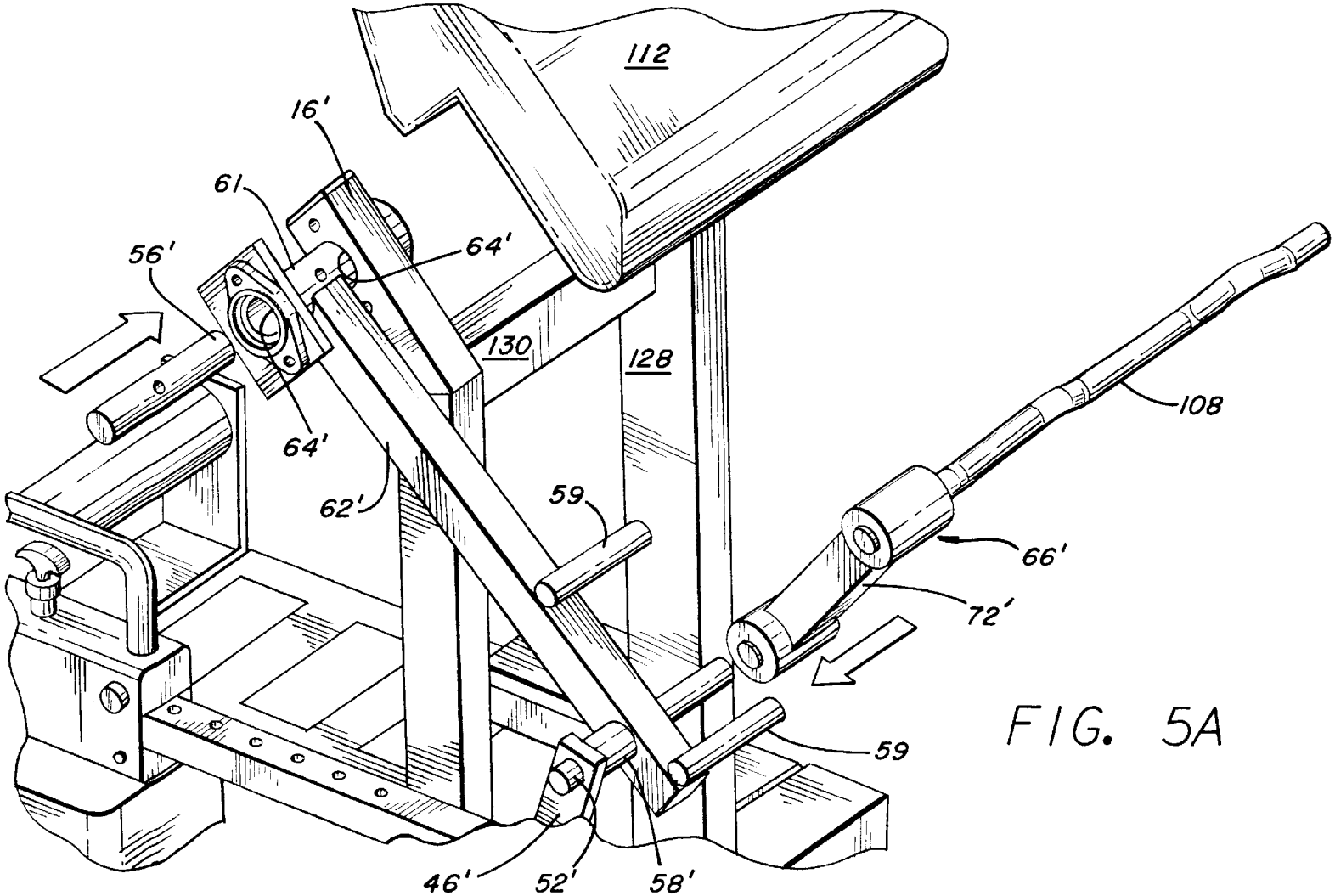
FIG. 5A is a cutaway view of a portion of the embodiment of FIG. 5 showing the structure around pivotal frame member 62'.

FIGS. 5 and 5A show a second embodiment of the linked leverage exercise system of the present invention, employed in the context of a biceps curl machine 106. This embodiment is quite similar to the first embodiment (the leg extension machine of FIG. 1), and thus need not be described in the same detail. The biceps curl machine 106 has a rigid frame 12' with a forward end ("F" in FIG. 5) and a rearward end ("R" in FIG. 5), with two upright members (18' and 20') rigidly attached to and extending upward from the rear of the frame 12', and connected by cross-bar 19. Support arm 16' is rigidly attached to and extends upward and rearward from a middle portion of the frame 12'. A mass swing arm 22' is provided for supporting the weight of a movable mass 24'. The mass swing arm 22' has forward and rearward ends which generally correspond to the forward and rearward ends of the frame 12', a U-shaped member 26' rigidly mounted to the rearward end of the mass swing arm 22', for pivotally mounting the swing arm to the frame 12', and a C-shaped member 40' also rigidly mounted to the mass swing arm 22'. The U-shaped member 26' has a swing arm axle 28', which rotatably engages a pair of swing arm pivot apertures 32' in the upright members (18' and 22'). The mass swing arm 22' has an adjustment tube 34' describing a plurality of mounting apertures, such as apertures 36'. The movable mass 24' is slidably mounted on the adjustment tube 34' and has a plurality of rollers (38 in FIGS. 1 and 3) engaging the top surface of the adjustment tube 34', allowing the movable mass 24' to roll over the adjustment tube 34'. The movable mass 24' may be adjusted in the same manner described above with reference to the first embodiment and FIGS. 1 and 3.

A hoisting link bar 46' has a lower aperture (not shown) at a lower end and its upper link bar aperture 52' at its upper end. The lower aperture receives lower link pivot 54' which is rigidly mounted to the mass swing arm 22', thus pivotally mounting the hoisting link bar 46' to the mass swing arm 22'. Upper link bar aperture 52' of the hoisting link bar receives a middle axle 58' from pivotal frame member 62', thus pivotally mounting the hoisting link bar 46' to the pivotal frame member 62'. The pivotal frame member 62' also has an upper sleeve 61 which receives upper axle 56' which is also received by pivotal apertures 64' in the support arm 16', thus pivotally connecting hoisting link bar 46' to the frame 12' through the pivotal mounting of the pivotal frame member 62' to the support arm 16'.

Depending upon the resistance profile desired, a user means 66' for receiving force from the user and transmitting same to the movable mass 24' can be located at various positions on the pivotal frame member 62'. In this second embodiment, designed for use in biceps curl exercises, the user means 66' is interconnected with the pivotal frame member 62' in a rotatable manner by being pivotally connected to the middle axle 58'. In this embodiment, the user means 66' comprises an accommodating lever arm 72' which is rotatably mounted to the user means 66', and a hand grip 108. An arm support 112, for supporting the underside of the user's arms as the user stands or sits rearward of the arm support 112 during curling exercises, is also provided. The arm support 112 is mounted to an arm support upright 128 at an upper end of the upright. The lower end of the arm support upright 128 is rigidly mounted to the base portion 14' of the frame 12'. A cross member 130 connects the arm support upright 128 to the support arm 16'. A pair of limit posts 59 are rigidly mounted to the pivotal frame member 62' on either side of the accommodating lever arm 72' thus limiting movement of the lever arm to less than 180 degrees, preventing the accommodating lever arm 72' and thus the user means 66' from rotating fully downward, beyond the user's comfortable reach. A seat (not shown) located rearward of the arm support 112 may be provided for users who do not wish to stand.

The mass swing arm 22' is equipped with an auxiliary weight holder 74' rigidly mounted to the forward end of the mass swing arm 22', on which weights (not shown) having a circular center aperture can be placed.

Operation of the biceps curl machine 106 is quite similar to that of the leg extension machine 10 of FIG. 1. The user will first adjust the resistance by moving the movable mass 24' as described above with reference to FIGS. 1, 3 and 4. Of course, rather than exercising the legs, a user of the biceps curl machine 106 will stand (or sit) rearward of the arm support 112, place the elbows on the arm support 112 and grasp the hand grip 108 in an underhand manner. Because of the flexibility allowed by the accommodating lever arm 72', the biceps curl machine 106 will accommodate a wide variety of arm lengths, in the same manner that the accommodating lever arm 72 of FIG. 1 allows the leg extension machine 10 to accommodate a wide variety of leg lengths. The user will lift and bring the hand grip 108 towards the user (i.e., upwardly and rearwardly). This will urge the accommodating lever arm 72' also upwardly and rearwardly. The accommodating lever arm 72' will urge the pivotal frame member 62' in an arc about the frame pivotal aperture 64'. The pivotal frame member 62' in turn urges the top end of the link bar 46' to rise in an arc centered about pivotal aperture 64'. The link bar 46', in rising, urges the mass swing arm 22' to pivot about the swing arm axle 28', resisting the user's movements.

Again, like the leg extension machine 10, the particular resistance profile to be experienced by the user of the biceps curl machine 106 is determined by the placement of the lower link pivot 54' along the mass swing arm 22', the relative lengths of the link bar 46' and the pivotal frame member 62', and the locations of the pivotal connections therebetween. In this embodiment, it has been found that a particularly desirable resistance profile can be achieved by utilizing a mass swing arm 22' of approximately 59 inches in length, with the swing arm axle 28' located about 12.75 inches from the rearward end of the mass swing arm 22'. The swing arm pivot apertures 32' and the swing arm axle 28' are approximately 28.4 inches above a base portion 14' of the frame 12'. The lower link pivot 54' is located about 37.5 inches forward (toward the auxiliary weight holder 74') of the swing arm axle 28' (measured horizontally). The link bar 46' is approximately 18.75 inches long (with the distance between the two apertures approximately 16.75 inches). The pivotal frame member 62' is about 22 inches long (measured from the point receiving the frame pivotal aperture 64' to the middle axle 58'). The accommodating lever arm 72' is approximately 9.5 inches long, measured as the distance between the hand grip 108 and the middle axle 58'.

Figure 6:
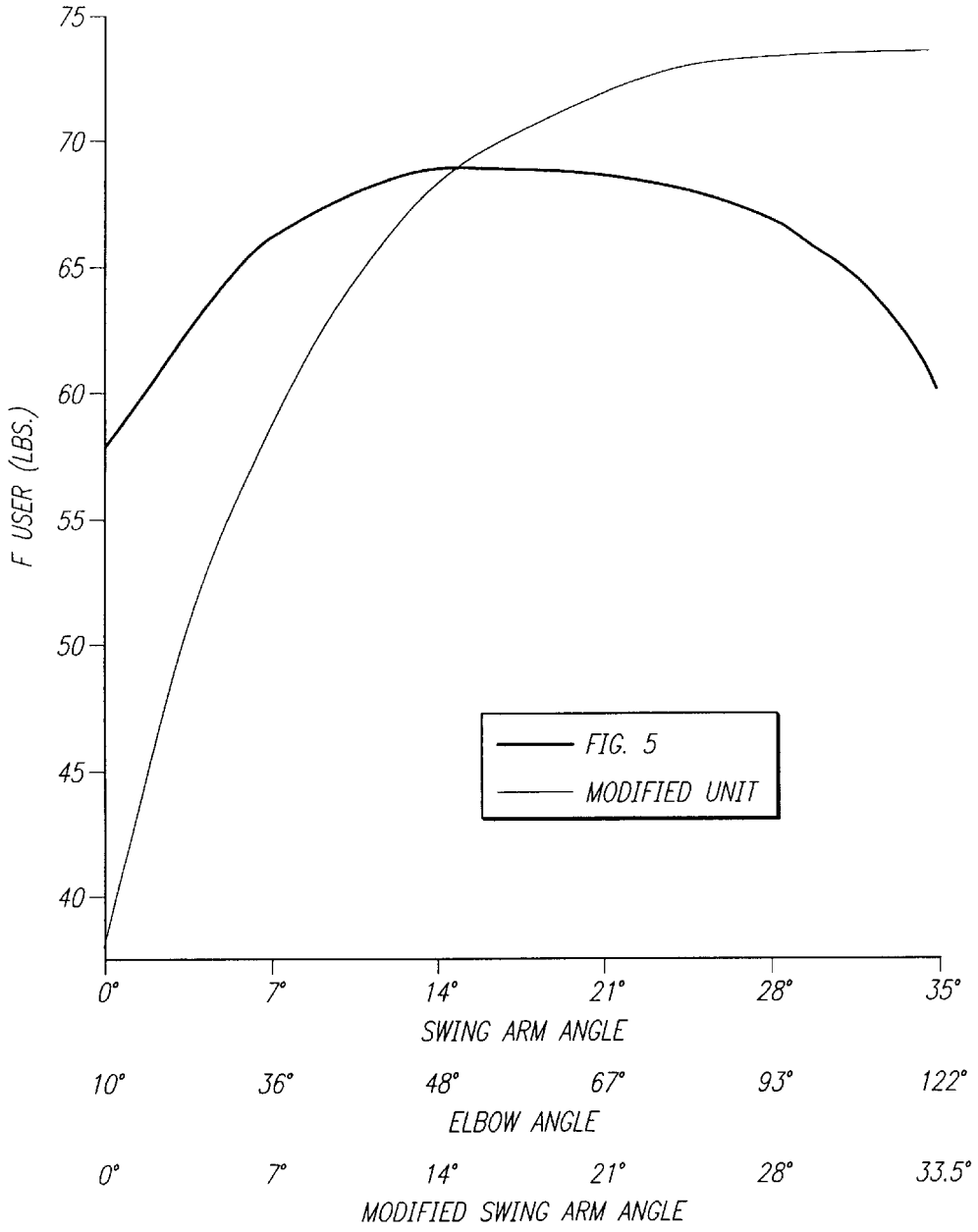
FIG. 6 is a graph showing the resistence profile experienced by the user of the machine depicted in FIG. 5 and the resistance profile experienced by the user of a modified form of the machine depicted in FIG. 5.

Varying any one of the above factors can significantly alter the resistance profile. FIG. 6 shows the resistance profile of the second embodiment (shown in FIG. 5) with a solid line and the resistance profile of a modified system with a broken line. In the modified system, the lower-link pivot 54 was moved forward approximately 13.5 inches. Just as in the comparison in FIG. 2, the force exerted by the user ($F_{-USER}$) varies significantly, especially at the beginning and end of the exercise cycle.

As can also be seen from FIG. 6, as the user (more specifically, in this embodiment, the user's arms) moves through the range of motion of the exercise (approximately 122 degrees), the mass swing arm 22 pivots only about 35 degrees. Significantly greater movement about the swing arm axle 28 would interfere with the resistance profile. For instance, if the mass swing arm 22 approached 90 degrees of movement, the resistance encountered by the user ($F_{-USER}$) would approach zero.

The embodiments of FIGS. 1 and 5 are shown as examples only. Various resistance-based exercise machines can be constructed employing the same principles, with pivot points and lengths adjusted to achieve the desired resistance profile.

Figure 7:
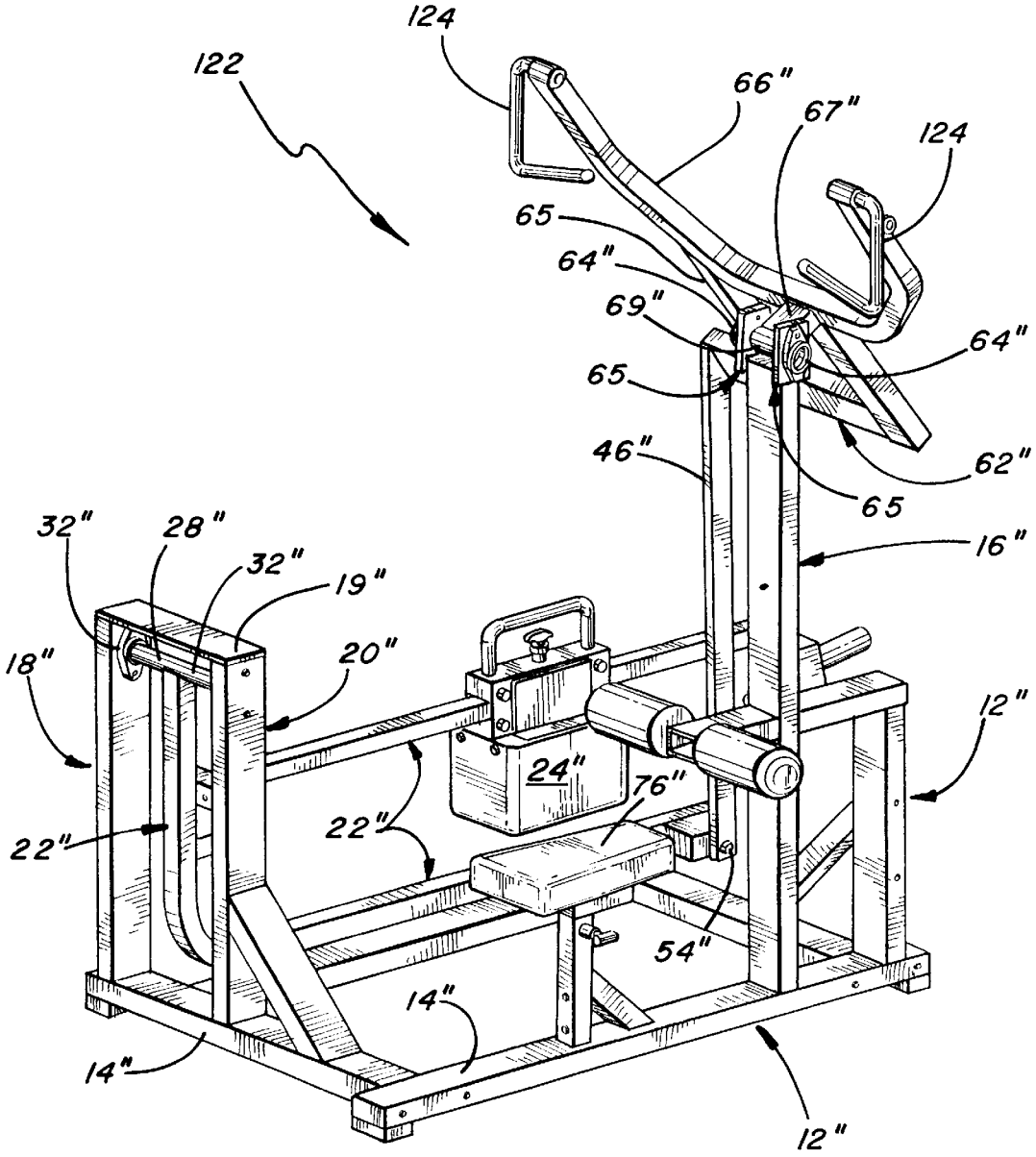
FIG. 7 is an isometric view of a third embodiment of the present invention, employed in the context of a lat pull-down machine.
Figure 9:
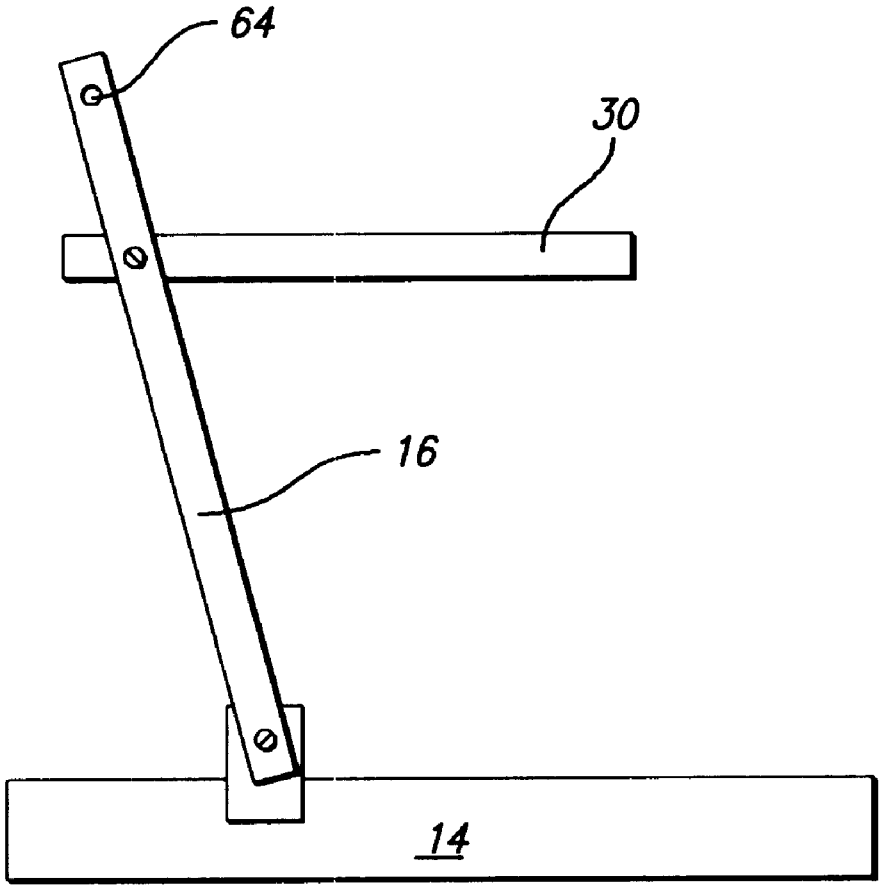
FIG. 9 is a schematic illustration an alternative embodiment of the connection for the support arm.

For instance, FIG. 7 shows the linked leverage system of the present invention incorporated into a lat pull-down machine 122. The lat pull-down machine 122 has a frame 12" with a base portion 14", a support arm 16" rigidly mounted to and extending upwardly from the base portion 14", and two upright members 18" and 20" also rigidly mounted to and extending from the base portion 14", each upright member having one of a pair of swing arm pivot apertures 32". A mass swing arm 22" has a swing arm axle 28" which is received by the swing arm pivot apertures 32" located at the upstanding end of the upright members 18" and 20", thus pivotally mounting the mass swing arm 22" to the frame 12". Upright members 18" and 20" are connected by cross-bar 19". A movable mass 24" is slidably mounted to the mass swing arm 22". Due to the similarity between this embodiment, and the leg extension machine 10 of FIG. 1, much of the structure need not be discussed in detail.

The lat pull-down machine 122 also has a hoisting link bar 46" pivotally receiving at its lower end a lower link pivot 54" from the mass swing arm 22", and pivotally connected to a pivotal frame member 62" at its upper end. The support arm 16" includes a pair of flanges 65 rigidly mounted at its upper end, each flange describing an aperture 64". A user means pivot (not shown) is received by each of the apertures 64" and extends therebetween.

As noted above, a user means can be mounted in various locations on the pivotal frame member or the hoisting link bar, depending upon the desired resistance profile. In this embodiment, a U-shaped user means 66" is rigidly mounted to the upper end of the pivotal frame member 62", preferably by welding. A pair of hand holds 124 are rotatably mounted to the U-shaped user means 66". The U-shaped user means 66" has an extension 67", rigidly abutting the user means at one end, and forming a sleeve 69" at the other end. The sleeve 69" surrounds the user means pivot (not shown) between the two apertures 64" in a rotatable manner, thus pivotally mounting the U-shaped user means 66" (and the pivotal frame member 62") to the support arm 16". An adjustable seat 76" is also provided.

In this embodiment, the user will adjust the adjustable seat 76" and the movable mass 24", sit down on the seat, grasp the hand holds 124 and pull downwardly. The hand holds 124 will urge the user means 66" downwardly, causing the user means pivot (not shown) to function as a fulcrum, with the pivotal frame member 62" thus rising. The pivotal frame member 62" urges the hoisting link bar 46" upwardly, in turn urging the mass swing arm 22" to rotate upwardly about swing arm axle 28".

Just as with the other embodiments, the particular resistance profile to be experienced by the user of the lat pull-down machine 122, is determined by the placement of the lower link pivot 54" along the mass swing arm 22", the relative lengths of the link bar 46" and the pivotal frame member 62", and the locations of the pivotal connections there between.

Figure 8:
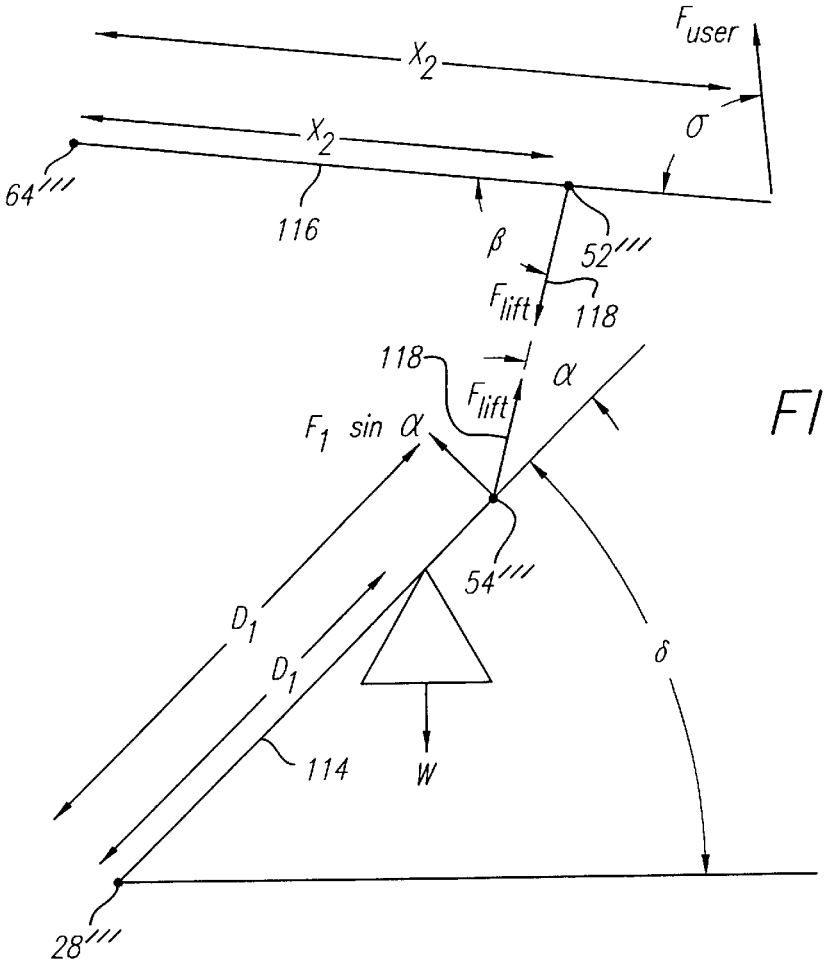
FIG. 8 is a schematic illustration showing the change in effort expended by the user to overcome resistance in operating the three embodiments of the present invention shown in FIGS. 1, 5 and 7.

FIG. 8 shows how the length and placement of the present invention's lifting arms, a first lifting arm 114 (mass swing arm 22 in FIGS. 1, 5 and 7), a second lifting arm 116 (pivotal frame member 62 in FIGS. 1, 5 and 7), and a linkage arm 118 (hoisting link bar 46 in FIGS. 1, 5 and 7), control $F_{-USER}$. In fact, any single adjustment, in isolation, will have an effect.

For instance, if a lower link pivot 54'" is moved along the first lifting arm 114 (mass swing arm 22) towards the swing arm axle 28'", the $F_{-USER}$ increases, while moving the first lifting arm away from the swing arm axle 28'" will cause the $F_{-USER}$ to decrease. Similarly, pivotal aperture 64'" is positioned in the frame (frame shown as 12 in FIGS. 1, 5 and 7—not shown in FIG. 8) so that the arc of the second lifting arm 116 (pivotal frame member 62 in FIG. 1, 5 and 7) closely enough mimics the desired arc to prevent binding or gliding ($F_{-USER}$ that is unacceptably high or low during parts of the exercise stroke). Moving the upper link bar aperture 52'" along the second lifting arm 116 (pivotal frame member 62 in FIGS. 1, 5 and 7) towards frame pivotal aperture 64'" causes the $F_{-USER}$ to decrease, while moving the upper link bar aperture 52'" away from the aperture 64'" causes the $F_{-USER}$ to increase. Similarly, altering the length of the linkage arm 118 (hoisting link bar 46) will alter the force profile, particularly as such change effects the location of the pivotal connection of the linkage arm 118 to the first lifting arm 114 and to the second lifting arm 116. Rather than make such changes in isolation, modifying two or more of the variables of the pivot positions and respective lengths of the linkage arm 118 and second lifting arm 116 will not only modify the overall $F_{-USER}$ but modify it in terms of the force profile, that is, the force experienced by the user at various points of the exercise stroke. By modifying the pivot positions and respective lengths of the linkage arm 118 and second lifting arm 116, a desired resistance profile can be achieved, as illustrated in FIGS. 2 and 6.

Having now described these embodiments of the invention, those skilled in the art will understand how to make changes and modifications in the present invention to meet their specific requirements or conditions. Such changes and modifications may be made without departing from the scope and spirit of the invention as set forth in the following claims.

What is claimed is:

1. A linked leverage exercise system, comprising:

a pivotal frame member;

a frame comprising a support arm for mounting the pivotal frame member to the frame, said support arm being pivotally mounted to said frame adjacent to a first end of the support arm and being pivotally mounted to the pivotal frame member adjacent to a second end, and a means for locking said support arm in position;

a mass swing arm disposed generally horizontally in an at-rest position, said mass swing arm being pivotally connected to said frame for arcuate movement about said pivotal connections said mass swing arm comprising resistance means connected to the mass swing arm, and means for selectively varying the resistance of the resistance means;

a linkage assembly comprising a hoisting link bar and a pivotal frame member, said hoisting link bar pivotally interconnecting the mass swing arm with the pivotal frame member, said pivotal frame member pivotally interconnecting the hoisting link bar with the frame;

means for selecting the relative lengths of the hoisting link bar and the pivotal frame member; and means for selecting the locations of the pivot connections of the mass swing arm to the frame and the mass swing arm to the hoisting link bar, and the location of the pivotal connection of the pivotal frame member to the hoisting link bar;

whereby various force profiles are achieved by selecting the relative lengths of the hoisting link bar and the pivotal frame member, the locations of the pivot connections of the mass swing arm to the frame and the mass swing arm to the hoisting link bar, and the location of the pivotal connection of the pivotal frame member to the hoisting link bar.

2. The exercise system of claim 1 wherein the mass swing arm further comprises an adjustment tube extending substantially the length of the mass swing arm with said resistance means slidably mounted thereto.

3. The exercise system of claim 1 further comprising a user means for transmitting force from a user to the mass swing arm, said user means being interconnected with said linkage assembly and having a user interface, for receiving force from a user.

4. The exercise system of claim 3 wherein said user means is pivotally mounted to said pivotal frame member.

5. The exercise system of claim 3 wherein said user means is pivotally mounted to said hoisting link bar.

6. The exercise system of claim 3 wherein said user means is rigidly mounted to said pivotal frame member.

7. The exercise system of claim 3 wherein said user means is rigidly mounted to said hoisting link bar.

8. The exercise system of claim 3 wherein said user means comprises an accommodating lever arm, the accommodating lever arm further comprising:

a linkage pivot pivotally connected to the linkage assembly;

a user pivot pivotally connected to the user interface and generally parallel in orientation to the linkage pivot; and a connection member connecting the frame pivot to the user pivot;

whereby the connection member is of such a length as to allow the user means to accommodate users with different body dimensions.

9. The exercise system of claim 1 further comprising a weight means connected to the mass swing arm.

10. The exercise system of claim 9 wherein the weight means comprises a selector means for engaging a selected point on the mass swing arm, and a single weight which is connected to and descends from the selector means.

11. The exercise system of claim 10 wherein the mass swing arm further comprises an upper portion and a lower portion, the upper portion comprising an adjustment tube for engaging said selector means, and the lower portion comprising a pivot for connecting the hoisting link bar to the mass swing arm.

12. The exercise system of claim 1 wherein the position of the weight means along the mass swing arm remains constant during an exercise stroke.

13. The exercise system of claim 1 further comprising a single mass swing arm.

14. The exercise system of claim 1 wherein the pivotal frame member is adjustable in length.

15. The exercise system of claim 14 wherein the pivotal frame member further comprises a telescoping mechanism for adjusting the length of said pivotal frame member.

16. The exercise system of claim 14 wherein the hoisting link bar is adjustable in length.

17. The exercise system of claim 16 wherein the hoisting link bar further comprises a telescoping mechanism for adjusting the length of said hoisting link bar.

18. The exercise system of claim 1 further comprising a plurality of lower link pivots positioned along the mass swing arm for pivotally mounting the hoisting link bar to the mass swing arm, whereby various force profiles can be achieved by mounting the hoisting link bar to a selected one of said plurality of lower link pivots.

19. A linked leverage exercise system, comprising:

a pivotal frame member;

a frame comprising a support arm for mounting the pivotal frame member to the frame, said support arm being mounted to said frame adjacent to a first end of the support arm and being pivotally mounted to the pivotal frame member adjacent to a second end, and means for securing said support arm in position;

a mass swing arm disposed generally horizontally in an at-rest position, said mass swing arm being pivotally mounted to said frame for arcuate movement about said pivotal mounting;

a weight means mounted on said mass swing arm for providing resistance to the user;

means for selectively engaging the weight means at various positions on the mass swing arm;

a user means for transmitting force from a user to the mass swing arm; and a linkage assembly for pivotally interconnecting the mass swing arm with the user means and the frame, said linkage assembly comprising a hoisting link bar and a pivotal frame member, said hoisting link bar pivotally interconnecting the mass swing arm with the pivotal frame member, said pivotal frame member pivotally interconnecting the hoisting link bar with the frame, and said user means pivotally mounted to the linkage assembly;

whereby various force profiles are predetermined by the relative lengths of the hoisting link bar and the pivotal frame member, the locations of the pivot connections of the mass swing arm to the frame and the mass swing arm to the hoisting link bar, and the location of pivotal mounting of the user means to the linkage assembly.

20. The exercise system of claim 19 wherein the mass swing arm further comprises an adjustment tube extending substantially the length of the mass swing arm with said weight means slidably mounted thereto.

21. The exercise system of claim 19 wherein said user means is pivotally mounted to said pivotal frame member.

22. The exercise system of claim 19 wherein said user means is pivotally mounted to said hoisting link bar.

23. The linked leverage exercise system of claim 13 wherein said user means is rigidly mounted to said pivotal frame member.

24. The exercise system of claim 19 wherein said user means is rigidly mounted to said hoisting link bar.

25. The exercise system of claim 13 wherein said user means comprises a user interface for receiving force from a user and an accommodating lever, the accommodating lever arm further comprising:

a frame pivot, pivotally connected to the pivotal frame member;

a user pivot, pivotally connected to the user interface and generally parallel in orientation to the frame pivot; and a connection member, connecting the frame pivot to the user pivot;

whereby the length of the connection member allow the user means to accommodate users with different body dimensions.

26. The exercise system of claim 19 wherein the weight means directly rides on the mass swing arm.

27. The exercise system of claim 26 wherein the weight means comprises a selector means for engaging a selected point on the mass swing arm, and a single weight which is connected to and descends from the selector means.

28. The exercise system of claim 27 wherein the mass swing arm further comprises an upper portion and a lower portion, the upper portion comprising an adjustment tube for engaging said selector means, and the lower portion comprising a pivot for connecting the hoisting link bar to the mass swing arm.

29. The exercise system of claim 19 wherein the position of the weight means along the mass swing arm remains constant during an exercise stroke.

30. The exercise system of claim 19 further comprising a single mass swing arm.

31. The exercise system of claim 19 wherein the pivotal frame member is adjustable in length.

32. The exercise system of claim 31 wherein the pivotal frame member further comprises a telescoping mechanism for adjusting the length of said pivotal frame member.

33. The exercise system of claim 31 wherein the hoisting link bar is adjustable in length.

34. The exercise system of claim 33 wherein the hoisting link bar further comprises a telescoping mechanism for adjusting the length of said hoisting link bar.

35. The exercise system of claim 19 further comprising a plurality of lower link pivots positioned along the mass swing arm for pivotally mounting the hoisting link bar to the mass swing arm, whereby various force profiles can be achieved by mounting the hoisting link bar to a selected one of said plurality of lower link pivots.

36. A linked leverage exercise system comprising:

a pivotal frame member;

a frame further comprising a support arm for mounting the pivotal frame member to the frame, said support arm being pivotally mounted to said frame adjacent to a first end of the support arm and being pivotally mounted to the pivotal frame member adjacent to a second end, and a means for locking said support arm in position;

a single mass swing arm disposed generally horizontally in an at-rest position, said mass swing arm being pivotally mounted to said frame for arcuate movement about said pivotal mounting;

weight means mounted on and depending from said mass swing arm for providing resistance to a user;

means for selectively engaging the weight means at various positions on the mass swing arm whereby the position of the weight means along the mass swing arm remains constant during an exercise stroke;

a user means for transmitting force from a user to the mass swing arm; and a linkage assembly for pivotally interconnecting the mass swing arm with the user means and the frame, said linkage assembly comprising a hoisting link bar and a pivotal frame member, said hoisting link bar pivotally interconnecting the mass swing arm with the pivotal frame member, said pivotal frame member pivotally interconnecting the hoisting link bar with the frame, and said user means mounted to the linkage assembly;

whereby various force profiles are predetermined by selecting the relative lengths of the hoisting link bar and the pivotal frame member, selecting the locations of the pivot connections of the mass swing arm to the frame and the mass swing arm to the hoisting link bar, and selecting the location of the pivotal mounting of the user means to the linkage assembly.

37. The exercise system of claim 36 wherein the pivotal frame member further comprises a telescoping mechanism for adjusting the length of said pivotal frame member.

38. The exercise system of claim 37 wherein the hoisting link bar further comprises a telescoping mechanism for adjusting the length of said hoisting link bar.

39. The exercise system of claim 36 further comprising a plurality of lower link pivots positioned along the mass swing arm for pivotally mounting the hoisting link bar to the mass swing arm, whereby various force profiles can be achieved by mounting the hoisting link bar to a selected one of said plurality of lower link pivots.

* * * * *